US008188946B2

(12) United States Patent
Nathan et al.

(10) Patent No.: US 8,188,946 B2
(45) Date of Patent: May 29, 2012

(54) COMPENSATION TECHNIQUE FOR LUMINANCE DEGRADATION IN ELECTRO-LUMINANCE DEVICES

(75) Inventors: Arokia Nathan, Waterloo (CA); G. Reza Chaji, Waterloo (CA); Shahin Jafarabadiashtiani, Waterloo (CA)

(73) Assignee: Ignis Innovation Inc., Ontario, CA (US)

( * ) Notice: Subject to any disclaimer, the term of this patent is extended or adjusted under 35 U.S.C. 154(b) by 1426 days.

(21) Appl. No.: 11/519,338

(22) Filed: Sep. 12, 2006

(65) Prior Publication Data

US 2007/0063932 A1 Mar. 22, 2007

(30) Foreign Application Priority Data

Sep. 13, 2005 (CA) ..... 2518276

(51) Int. Cl.
*G09G 3/30* (2006.01)

(52) U.S. Cl. ..... 345/77; 345/78; 345/92

(58) Field of Classification Search ..... 345/76, 345/82, 77, 98, 96, 90, 78, 45
See application file for complete search history.

(56) References Cited

U.S. PATENT DOCUMENTS

| | | | | |
|---|---|---|---|---|
| 6,229,508 | B1 | 5/2001 | Kane | |
| 6,618,030 | B2 | 9/2003 | Kane et al. | |
| 6,909,243 | B2 | 6/2005 | Inukai | |
| 7,339,560 | B2 * | 3/2008 | Sun | 345/76 |
| 7,411,571 | B2 * | 8/2008 | Huh | 345/80 |
| 7,580,012 | B2 * | 8/2009 | Kim et al. | 345/76 |
| 2004/0070557 | A1 * | 4/2004 | Asano et al. | 345/76 |
| 2004/0100427 | A1 * | 5/2004 | Miyazawa | 345/76 |
| 2004/0174354 | A1 | 9/2004 | Ono et al. | |
| 2005/0200575 | A1 * | 9/2005 | Kim et al. | 345/76 |
| 2005/0285825 | A1 * | 12/2005 | Eom et al. | 345/76 |
| 2006/0103611 | A1 * | 5/2006 | Choi | 345/82 |
| 2007/0057873 | A1 | 3/2007 | Uchino et al. | |
| 2008/0150847 | A1 * | 6/2008 | Kim et al. | 345/82 |

FOREIGN PATENT DOCUMENTS

| | | | |
|---|---|---|---|
| WO | 03/001496 | A1 | 1/2003 |
| WO | 2004/104975 | A1 | 12/2004 |

OTHER PUBLICATIONS

Alexander et al.: "Pixel circuits and drive schemes for glass and elastic AMOLED displays"; dated Jul. 2005 (9 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).

(Continued)

*Primary Examiner* — Quan-Zhen Wang
*Assistant Examiner* — Tony Davis
(74) *Attorney, Agent, or Firm* — Nixon Peabody LLP

(57) ABSTRACT

A method and system for compensation for luminance degradation in electro-luminance devices is provided. The system includes a pixel circuit having a light emitting device, a storage capacitor, a plurality of transistors, and control signal lines to operate the pixel circuit. The storage capacitor is connected or disconnected to the transistor and a signal line (s) when programming and driving the pixel circuit.

40 Claims, 12 Drawing Sheets

OTHER PUBLICATIONS

Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "Driving scheme for stable operation of 2-TFT a-Si AMOLED pixel"; dated Apr. 2005 (2 pages).
Chaji et al.: "eUTDSP: a design study of a new VLIW-based DSP architecture"; dated May 2003 (4 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost Stable a-Si:H AMOLED Display for Portable Applications"; dated Jun. 2006 (4 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated 2006 (4 pages).
Philipp: "Charge transfer sensing" SENSOR REVIEW, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical X-ray imaging"; dated Jun. 2006 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).

* cited by examiner

COMPENSATION TECHNIQUE FOR LUMINANCE DEGRADATION IN ELECTRO-LUMINANCE DEVICES

FIELD OF INVENTION

The present invention relates to electro-luminance device displays, and more specifically to a driving technique for the electro-luminance device displays to compensate for luminance degradation.

BACKGROUND OF THE INVENTION

Electro-luminance displays have been developed for a wide variety of devices, such as cell phones. In particular, active-matrix organic light-emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

There is a need to provide a method and system that is capable of providing constant brightness with high accuracy and reducing the effect of the aging of the pixel circuit.

SUMMARY OF THE INVENTION

It is an object of the invention to provide a method and system that obviates or mitigates at least one of the disadvantages of existing systems.

In accordance with an aspect of the present invention there is provided a pixel circuit including a light emitting device and a storage capacitor having a first terminal and a second terminal. The pixel circuit includes a first transistor having a gate terminal, a first terminal and a second terminal where the gate terminal is connected to a first select line. The pixel circuit includes a second transistor having a gate terminal, a first terminal and a second terminal where the first terminal is connected to the second terminal of the first transistor, and the second terminal is connected to the light emitting device. The pixel circuit includes a third transistor having a gate terminal, a first terminal and a second terminal where the gate terminal is connected to a second select line, the first terminal is connected to the second terminal of the first transistor, and the second terminal is connected to the gate terminal of the second transistor and the first terminal of the storage capacitor. The pixel circuit includes a fourth transistor having a gate terminal, a first terminal and a second terminal where the gate terminal is connected to a third select line, the first terminal is connected to the second terminal of the storage capacitor, and the second terminal is connected to the second terminal of the second transistor and the light emitting device. The pixel circuit includes a fifth transistor having a gate terminal, a first terminal and a second terminal where the gate terminal is connected to the second select line, the first terminal is connected to a signal line, and the second terminal is connected to the first terminal of the forth transistor and the second terminal of the storage capacitor.

In the above pixel circuit, the third select line may be the first select line.

The above pixel circuit may include a sixth transistor having a gate terminal, a first terminal and a second terminal where the gate terminal is connected to the second select line, the first terminal is connected to the first terminal of the second transistor, and the second terminal is connected to a bias current line.

In accordance with a further of the present invention there is provided a display system including a display array formed by the pixel circuit, and a driving module for programming and driving the pixel circuit.

In accordance with a further of the present invention there is provided a method for compensating for degradation of the light emitting device in the pixel circuit. The method includes the steps of charging the storage capacitor and discharging the storage capacitor. The step of charging the storage capacitor includes connecting the storage capacitor to the signal line. The method includes the step of disconnecting the storage capacitor from the signal line and connecting the second terminal of the storage capacitor to the second terminal of the second transistor.

In accordance with a further of the present invention there is provided a method for compensating for shift in a threshold voltage of the transistor in the pixel circuit. The method includes the steps of charging the storage capacitor and discharging the storage capacitor. The step of charging the storage capacitor includes connecting the storage capacitor to the signal line. The method includes the step of disconnecting the storage capacitor from the signal line and connecting the second terminal of the storage capacitor to the second terminal of the second transistor.

In accordance with a further of the present invention there is provided a method for compensating for ground bouncing or IR drop in the pixel circuit. The method includes the steps of charging the storage capacitor and discharging the storage capacitor. The step of charging the storage capacitor includes connecting the storage capacitor to the signal line and the bias current line. The method includes the step of disconnecting the storage capacitor from the signal line and the bias current line and connecting the second terminal of the storage capacitor to the second terminal of the second transistor.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using a pixel circuit having a light emitting device, such as an organic light emitting diode (OLED), and a plurality of transistors. However, the pixel circuit may include any light emitting device other than the OLED. The transistors in the pixel circuit may be n-type transistors, p-type transistors or combinations thereof. The transistors in the pixel circuit may be fabricated using amorphous silicon, nano/micro crystalline silicon, poly silicon, organic semiconductors technologies (e.g. organic TFT), NMOS/PMOS technology or CMOS technology (e.g. MOSFET). A display having the pixel circuit may be a single color, multi-color or a fully color display, and may include one or more than one electroluminescence (EL) element (e.g., organic EL). The display may be an active matrix light emitting display. The display may be used in DVDs, personal digital assistants (PDAs), computer displays, or cellular phones.

In the description, "pixel circuit" and "pixel" may be used interchangeably. In the description below, "signal" and "line" may be used interchangeably. In the description below, "connect (or connected)" and "couple (or coupled)" may be used interchangeably, and may be used to indicate that two or more elements are directly or indirectly in physical or electrical contact with each other.

The embodiments of the present invention involve a driving method of driving the pixel circuit, which includes an in-pixel compensation technique for compensating for at least one of OLED degradation, backplane instability (e.g. TFT threshold shift), and ground bouncing (or IR drop). The driving scheme allows the pixel circuit to provide a stable luminance independent of the shift of the characteristics of pixel elements due to, for example, the pixel aging under prolonged display operation and process variation. This enhances the brightness stability of the OLED and efficiently improves the display operating lifetime.

Figure 1A:
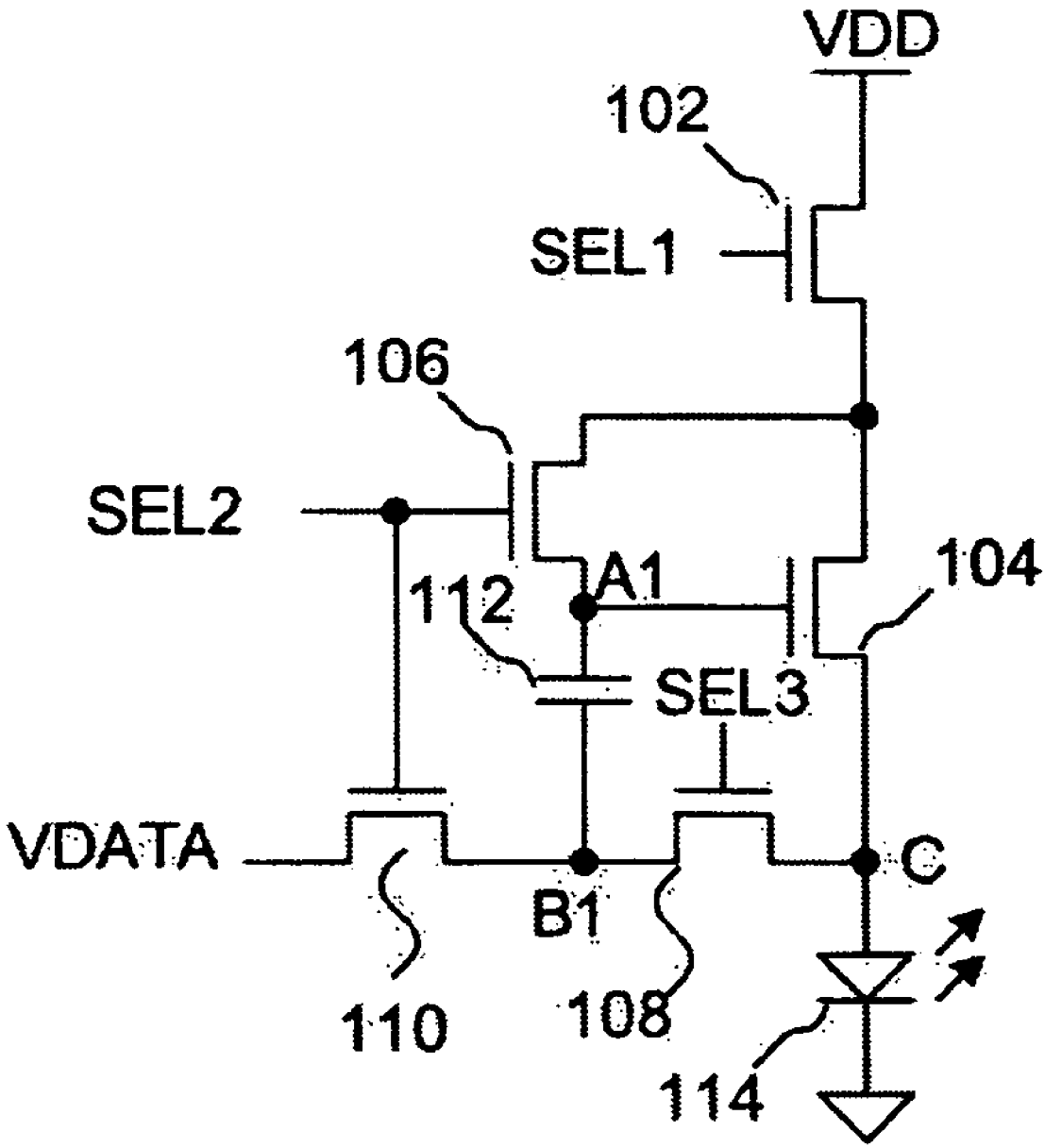
FIG. 1A is a diagram illustrating an example of a pixel circuit along with its control signal lines to which a pixel driving scheme in accordance with an embodiment of the present invention is applied.

FIG. 1A illustrates an example of a pixel circuit along with its control signal lines to which a pixel driving scheme in accordance with an embodiment of the present invention is applied. The pixel circuit 100 of FIG. 1A includes transistors 102-110, a storage capacitor 112 and an OLED 114. The pixel circuit 100 is connected to three select lines SEL1, SEL2, and SEL3, a signal line VDATA, a voltage line VDD, and a common ground.

The transistors 102-110 may be amorphous silicon, poly silicon, or organic thin-film transistors (TFT) or standard NMOS in CMOS technology. It would be appreciated by one of ordinary skill in the art that the pixel circuit 100 can be rearranged using p-type transistors.

The transistor 104 is a driving transistor. The source and drain terminals of the driving transistor 104 are connected to the anode electrode of the OLED 114 and the source terminal of the transistor 102, respectively. The gate terminal of the driving transistor 104 is connected to the signal line VDATA through the transistor 110 and is connected to the source terminal of the transistor 106. The drain terminal of the transistor 106 is connected to the source terminal of the transistor 102 and its gate terminal is connected to the select line SEL2.

The drain terminal of the transistor 108 is connected to the source terminal of the transistor 110, its source terminal is connected to the anode of the OLED 114, and its gate terminal is connected to the select line SEL3.

The drain terminal of the transistor 110 is connected to the signal line VDATA, and its gate terminal is connected to the select line SEL2.

The driving transistor 104, the transistor 106 and the storage capacitor 112 are connected at node A1. The transistors 108 and 110 and the storage capacitor 112 are connected at node B1.

Figure 1B:
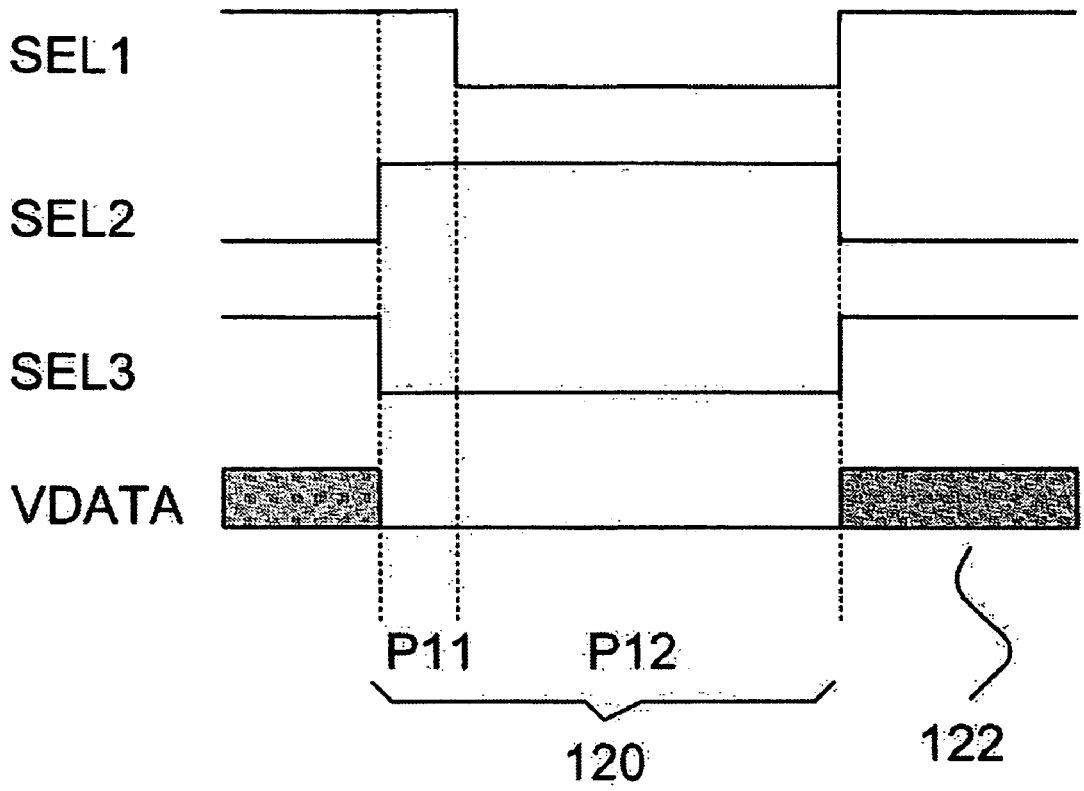
FIG. 1B is a timing diagram illustrating an example of a method of operating the pixel circuit of FIG. 1A.

FIG. 1B illustrates an example of a method of operating the pixel circuit 100 of FIG. 1A. The pixel circuit 100 of FIG. 1A includes n-type transistors. However, it would be understood by one of ordinary skill in the art that the method of FIG. 1B is applicable to a pixel circuit having p-type transistors.

Referring to FIGS. 1A-1B, the operation of the pixel circuit 100 includes two operating cycles: programming cycle 120 and driving cycle 122. At the end of the programming cycle 120, node A1 is charged to $(V_P+V_T+\Delta V_{OLED})$ where $V_P$ is a programming voltage, $V_T$ is the threshold voltage of the transistor 104, and $\Delta V_{OLED}$ is the OLED voltage shift under bias stress.

The programming cycle 120 includes two sub-cycles: pre-charging P11 and compensation P12, hereinafter referred to as pre-charging sub-cycle P11 and compensation sub-cycle P12, respectively.

During the pre-charging sub-cycle P11, the select lines SEL1 and SEL2 are high and SEL3 is low, resulting in turning the transistors 102, 106 and 110 on, and the transistor 108 off respectively. The voltage at VDATA is set to $(V_{OLEDi}-V_P)$. "$V_P$" is a programming voltage. "i" represents initial voltage of OLED. "$V_{OLEDi}$" is a constant voltage and can be set to the initial ON voltage of the OLED 114. However, $V_{OLEDi}$ can be set to other voltages such as zero. At the end of the pre-charging sub-cycle P11, the storage capacitor 112 is charged with a voltage close to $(VDD+V_P-V_{OLEDi})$.

During the compensation sub-cycle P12, the select line SEL2 is high so that the transistors 106 and 110 are on, and the select lines SEL1 and SEL3 are low so that the transistors 102 and 108 are off. As a result, the storage capacitor 112 starts discharging through the transistor 104 and the OLED 114 until the current through the driving transistor 104 and the OLED 114 becomes close to zero. Consequently, the voltage close to $(V_T+V_P+V_{OLED}-V_{OLEDi})$ is stored in the storage capacitor 112 where $V_{OLED}$ is the ON voltage of the OLED 114.

During the driving cycle 122, the select line SEL2 is low so that the transistors 106 and 110 are off, and the select lines SEL1 and SEL3 are high so that the transistors 102 and 108 are on. As a result, the storage capacitor 112 is disconnected from the signal line VDATA and is connected to the source of the driving transistor 104.

If the driving transistor 104 is in saturation region, a current close to $K(V_{P+\Delta VOLED})^2$ goes through the OLED 114 until the next programming cycle where K is the trans-conductance coefficient of the driving transistor 104, and $\Delta V_{OLED}=V_{OLED}-V_{OLEDi}$.

Figure 2:
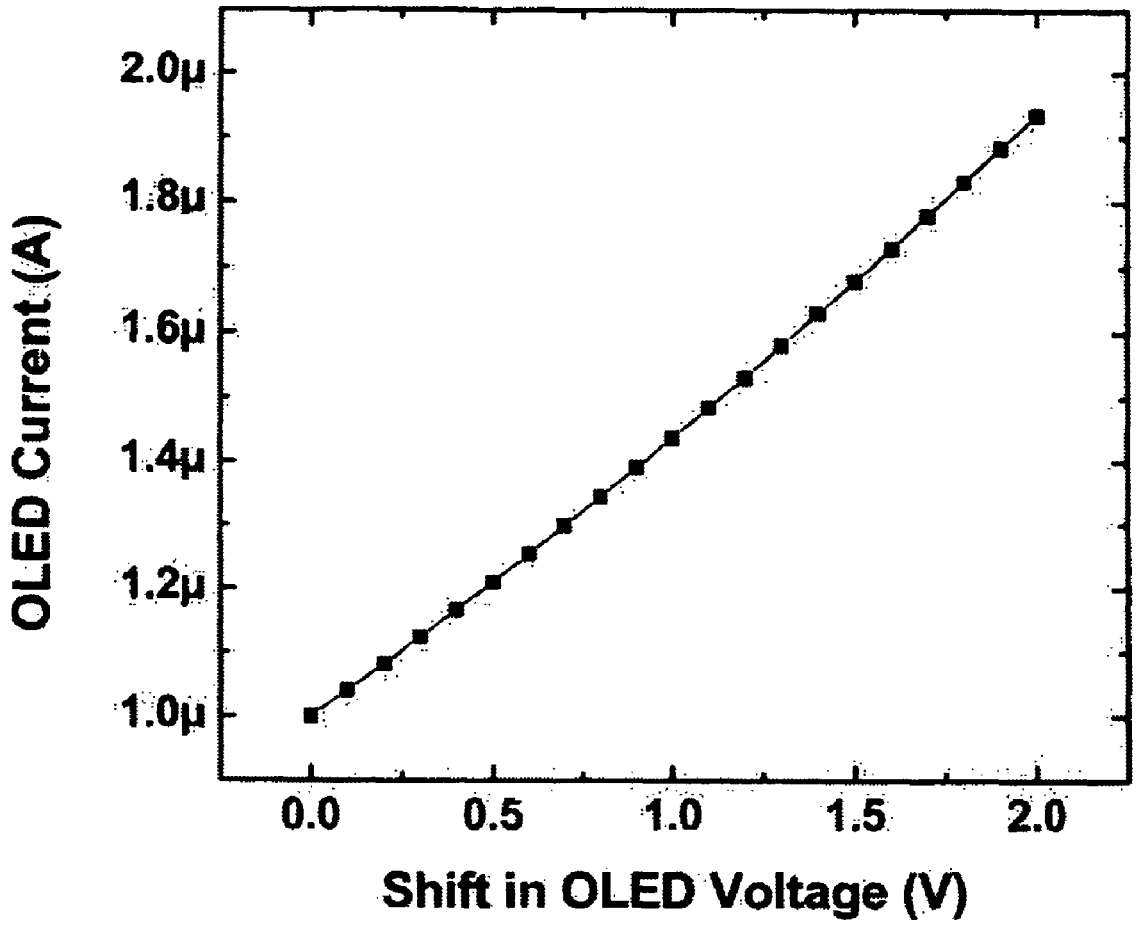
FIG. 2 is a graph illustrating a simulation result for FIGS. 1A-1B.

FIG. 2 illustrates an example of a simulation result for the operation of FIGS. 1A-1B. The graph of FIG. 2 represents OLED current during the driving cycle 122 as a function of shift in its voltage. Referring to FIGS. 1A, 1B and 2, it can be seen that as $\Delta V_{OLED}$ increases over time, the driving current of the OLED 114 is also increased. Thus, the pixel circuit 100 compensates for luminance degradation of the OLED 114 by increasing the driving current of the OLED 114.

Figure 3:
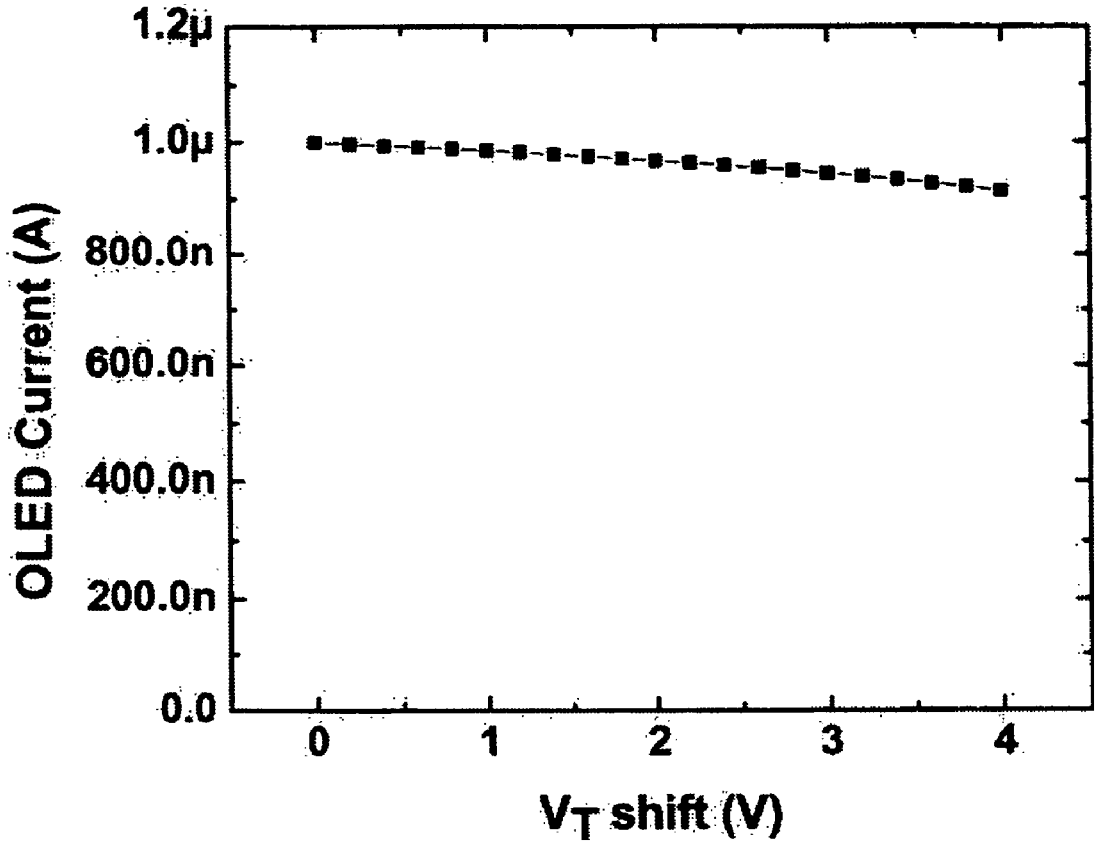
FIG. 3 is a graph illustrating another simulation result for FIGS. 1A-1B.

FIG. 3 illustrates an example of another simulation result for the operation of FIGS. 1A-1B. The graph of FIG. 3 represents OLED current during the driving cycle 122 as a function of shift in the threshold voltage of the driving transistor 104. Referring to FIGS. 1A, 1B and 3, the pixel circuit 100 compensates for shift in the threshold voltage of the driving transistor 104 since the driving current of the OLED 114 is independent of the threshold of the driving transistor 104. The result as shown in FIG. 3 emphasizes the OLED current stability for 4-V shift in the threshold of the driving transistor.

Figure 4A:
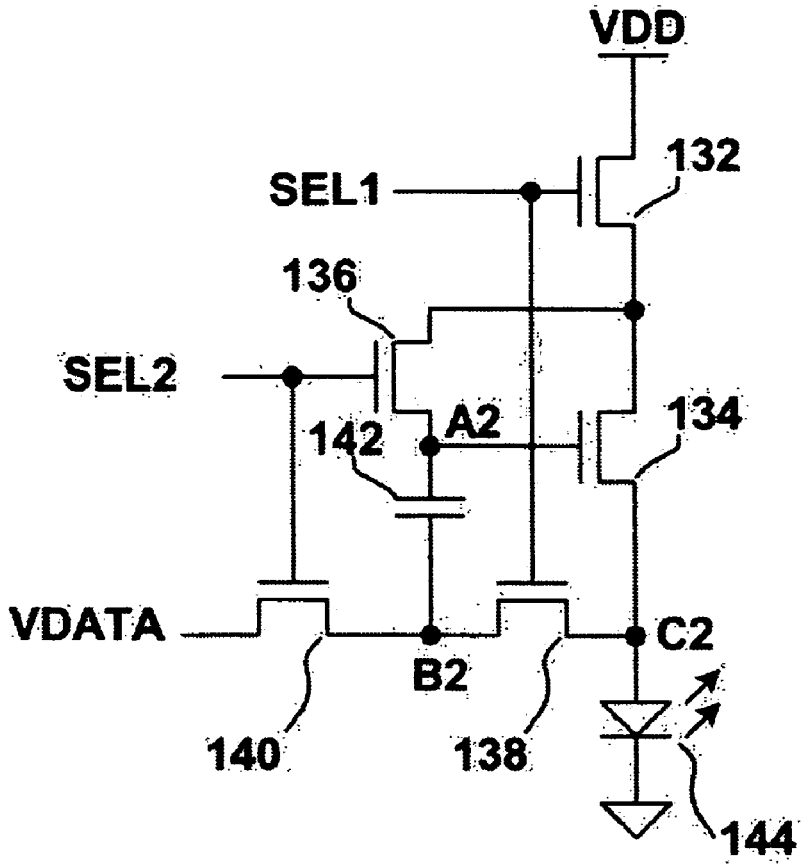
FIG. 4A is a diagram illustrating an example of a pixel circuit along with its control signal lines to which the pixel driving scheme in accordance with another embodiment of the present invention is applied.

FIG. 4A illustrates an example of a pixel circuit along with its control signal lines to which the pixel driving scheme in accordance with another embodiment of the present invention is applied. The pixel circuit 130 of FIG. 4A includes five transistors 132-140, a storage capacitor 142 and an OLED 144. The pixel circuit 130 is connected to two select lines SEL1 and SEL2, a signal line VDATA, a voltage line VDD, and a common ground.

The transistors 132-140 may be same or similar to the transistors 102-110 of FIG. 1A. The transistors 132-140 may be amorphous silicon, poly silicon, or organic TFT or standard NMOS in CMOS technology. The storage capacitor 142 and the OLED 140 are same or similar to the storage capacitor 112 and the OLED 114 of FIG. 1A, respectively.

The transistor 134 is a driving transistor. The source and drain terminals of the driving transistor 134 are connected to the anode electrode of the OLED 144 and the source of the transistor 132, respectively. The gate terminal of the driving transistor 134 is connected to the signal line VDATA through the transistor 140, and is connected to the source terminal of the transistor 136. The drain terminal of the transistor 136 is connected to the source terminal of the transistor 132 and its gate terminal is connected to the select line SEL2.

The drain terminal of the transistor 138 is connected to the source terminal of the transistor 140, its source terminal is connected to the anode of the OLED 144, and its gate terminal is connected to the select line SEL1.

The drain terminal of the transistor 140 is connected to the signal line VDATA, and its gate terminal is connected to the select line SEL2.

The driving transistor 134, the transistor 136 and the storage capacitor 142 are connected at node A2. The transistors 138 and 140 and the storage capacitor 142 are connected at node B2.

Figure 4B:
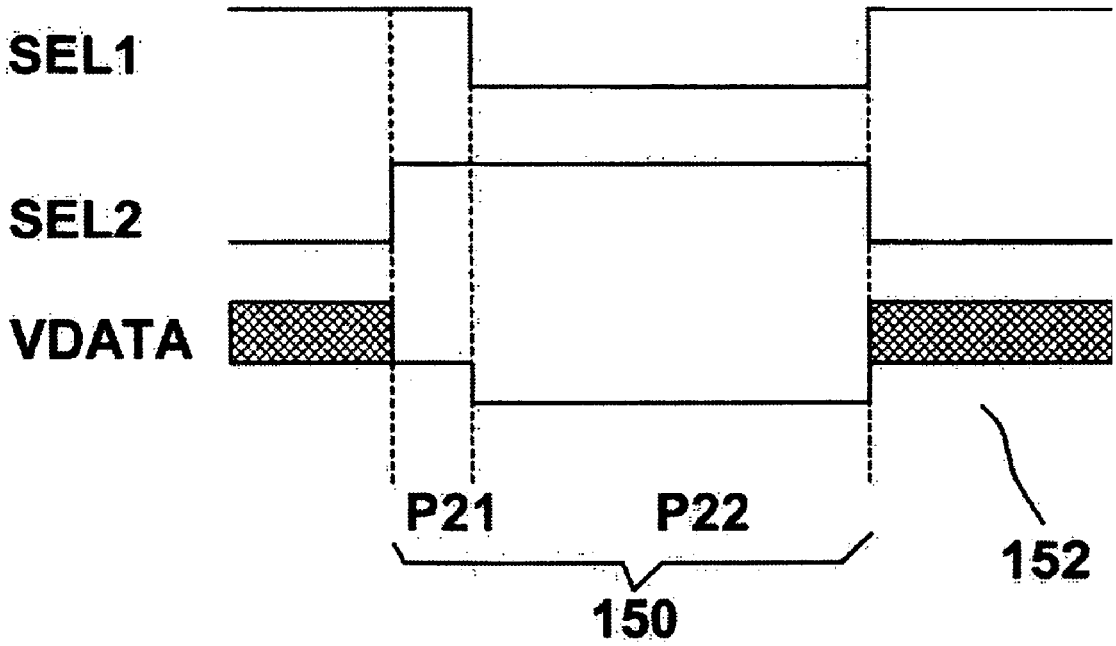
FIG. 4B is a timing diagram illustrating an example of a method of operating the pixel circuit of FIG. 4A.

FIG. 4B illustrates an example of a method of operating the pixel circuit 130 of FIG. 4A. The pixel circuit 130 of FIG. 4A includes n-type transistors. However, it would be understood by one of ordinary skill in the art that the method of FIG. 4B is applicable to a pixel circuit having p-type transistors.

Referring to FIGS. 4A-4B, the operation of the pixel circuit 130 includes two operating cycles: programming cycle 150 and driving cycle 152. At the end of the programming cycle 150, node A2 is charged to $(V_P+V_T+\Delta V_{OLED})$ where $V_P$ is a programming voltage, $V_T$ is the threshold voltage of the transistor 134, and $\Delta V_{OLED}$ is the OLED voltage shift under bias stress.

The programming cycle 150 includes two sub-cycles: pre-charging P21 and compensation P22, hereinafter referred to as pre-charging sub-cycle P21 and compensation sub-cycle P22, respectively.

During the pre-charging sub-cycle P21, the select lines SEL1 and SEL2 are high, and VDATA goes to a proper voltage $V_{OLEDi}$ that turns off the OLED 144. $V_{OLEDi}$ is a predefined voltage which is less than minimum ON voltage of the OLEDs. At the end of the pre-charging sub-cycle P21, the storage capacitor 142 is charged with a voltage close to $(VDD+V_{OLEDi})$. The voltage at VDATA is set to $(V_{OLEDi}-V_P)$ where $V_P$ is a programming voltage.

During the compensation sub-cycle P22, the select line SEL2 is high so that the transistors 136 and 140 are on, and the select line SEL1 is low so that the transistors 132 and 138 are off. The voltage of VDATA at P22 is different from that of P21 to properly charge A2 to $(V_P+V_T+\Delta V_{OLED})$ at the end of P22. As a result, the storage capacitor 142 starts discharging through the driving transistor 134 and the OLED 144 until the current through the driving transistor 134 and the OLED 144 becomes close to zero. Consequently, the voltage close to $(V_T+V_P+V_{OLED}-V_{OLEDi})$ is stored in the storage capacitor 142 where $V_{OLED}$ is the ON voltage of the OLED 144.

During the driving cycle 152, the select SEL2 is low, resulting in turning the transistors 136 and 140 off. The select line SEL1 is high, resulting in turning the transistors 132 and 138 on. As a result, the storage capacitor 142 is disconnected from the signal line VDATA and is connected to the source terminal of the driving transistor 134

If the driving transistor 134 is in saturation region, a current close to $K(V_P+\Delta V_{OLED})^2$ goes through the OLED 144 until the next programming cycle where K is the trans-conductance coefficient of the driving transistor 134, and $\Delta V_{OLED}=V_{OLED}-V_{OLEDi}$. As a result, the driving current of the OLED 144 increases, as the $\Delta V_{OLED}$ increases over time. Thus, the pixel circuit 130 compensates for luminance degradation of the OLED 144 by increasing the driving current of the OLED 144.

Moreover, the pixel circuit 130 compensates for shift in threshold voltage of the driving transistor 134 and so the driving current of the OLED 144 is independent of the threshold $V_T$.

Figure 5A:
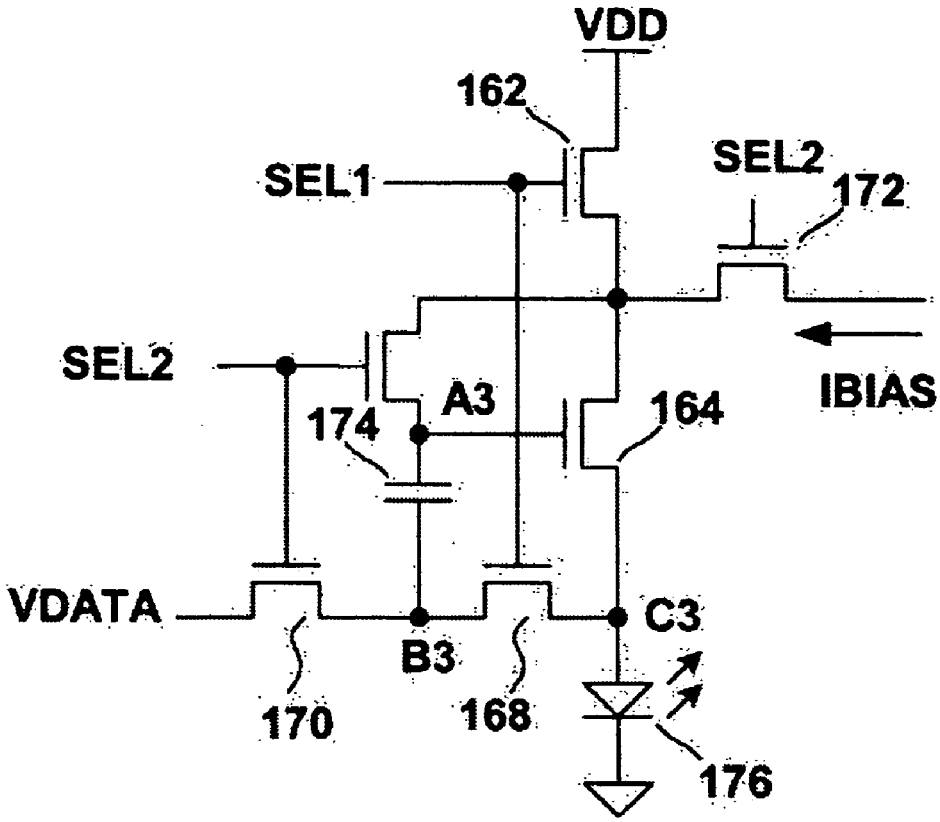
FIG. 5A is a diagram illustrating an example of a pixel circuit along with its control signal lines to which the pixel driving scheme in accordance with a further embodiment of the present invention is applied.

FIG. 5A illustrates an example of a pixel circuit along with its control signal lines to which the pixel driving scheme in accordance with a further embodiment of the present invention is applied. The pixel circuit 160 of FIG. 5A includes six transistors 162-172, a storage capacitor 174 and an OLED 176. The pixel circuit 160 is connected to two select lines SEL1 and SEL2, a signal line VDATA, a voltage line VDD, a bias current line IBIAS, and a common ground.

The transistors 162-172 may be amorphous silicon, poly silicon, or organic TFT or standard NMOS in CMOS technology. The storage capacitor 174 and the OLED 176 are same or similar to the storage capacitor 112 and the OLED 114 of FIG. 1A, respectively.

The transistor 164 is a driving transistor. The source and drain terminals of the driving transistor 164 are connected to the anode electrode of the OLED 176 and the source terminal of the transistor 162, respectively. The gate terminal of the driving transistor 164 is connected to the signal line VDATA through the transistor 170 and is connected to the source terminal of the transistor 166. The drain terminal of the transistor 166 is connected to the source terminal of the transistor 162 and its gate terminal is connected to the select line SEL2.

The drain terminal of the transistor 168 is connected to the source terminal of the transistor 170, its source terminal is connected to the anode of the OLED 176, and its gate terminal is connected to the select line SEL1.

The drain terminal of the transistor 170 is connected to VDATA, and its gate terminal is connected to the select line SEL2.

The drain terminal of the transistor 172 is connected to the bias line IBIAS, its gate terminal is connected to the select line SEL2, and its source terminal is connected to the source terminal of the transistor 162 and the drain terminal of the transistor 164.

The driving transistor 164, the transistor 166 and the storage capacitor 174 are connected at node A3. The transistors 168 and 170 and the storage capacitor 174 are connected at node B3.

Figure 5B:
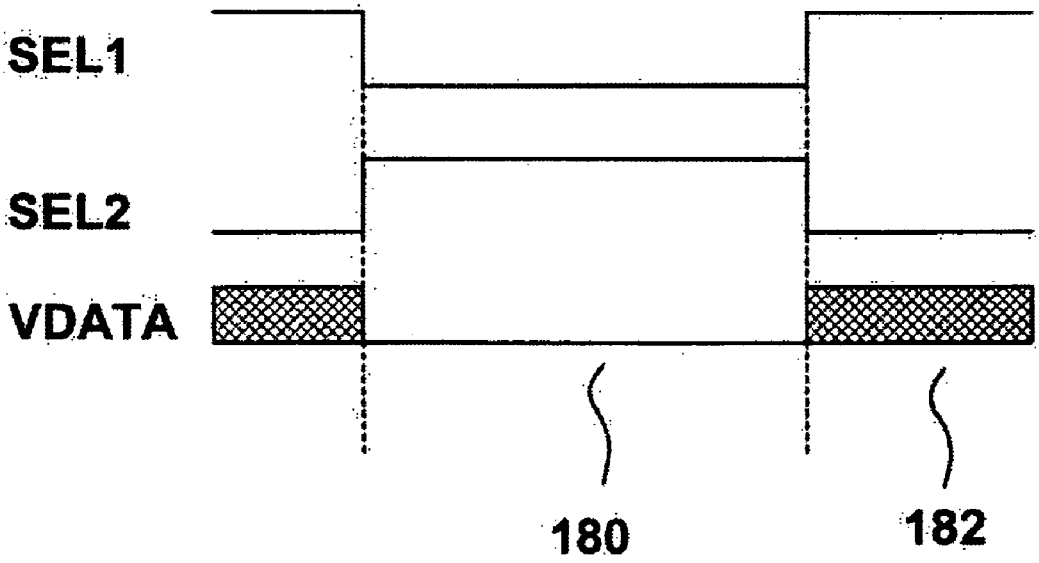
FIG. 5B is a timing diagram illustrating an example of a method of operating the pixel circuit of FIG. 5A.

FIG. 5B illustrates an example of a method of operating the pixel circuit 160 of FIG. 5A. The pixel circuit 160 of FIG. 5A includes n-type transistors. However, it would be understood by one of ordinary skill in the art that the method of FIG. 5B is applicable to a pixel circuit having p-type transistors.

Referring to FIGS. 5A-5B, the operation of the pixel circuit 160 includes two operating cycles: programming cycle 180 and driving cycle 182. At the beginning of the second operating cycle 182, node A3 is charged to $(V_P+V_T+\Delta V_{OLED})$ where $V_P$ is a programming voltage, $V_T$ is the threshold voltage of the transistor 164, and $\Delta V_{OLED}$ is the OLED voltage shift under bias stress. $V_T$ and $\Delta V_{OLED}$ are generated by large IBIAS resulting in a fast programming.

During the first operating cycle 180, the select line SEL1 is low, the select line SEL2 is high, and VDATA goes to a proper voltage $(V_{OLEDi}-V_P)$ where $V_P$ is a programming voltage. This proper voltage is a predefined voltage which is less than minimum ON voltage of the OLEDs. Also, the bias line IBIAS provides bias current (referred to as $I_{BIAS}$) to the pixel circuit 160. At the end of this cycle node A3 is charged to $V_{BIAS}+V_T+V_{OLED}(I_{BIAS})$ where $V_{BIAS}$ is related to the bias current $I_{BIAS}$, and $V_{OLED}(I_{BIAS})$ is the OLED 176 voltage corresponding to $I_{BIAS}$. Voltage at node A3 is independent of $V_P$ at the end of 180. Charging to $(V_P+V_T+\Delta V_{OLED})$ happens at the beginning of 182.

During the second operating cycle 182, the select line SEL1 is high and the select line SEL2 is low. As a result node B3 is charged to $V_{OLED}(I_P)$ where $V_{OLED}(I_P)$ is the OLED 176 voltage corresponding to the pixel current. Thus, the gate-source voltage of the transistor 164 becomes $(V_P+\Delta V_{OLED}+V_T)$ where $\Delta V_{OLED}=V_{OLED}(I_{BIAS})-V_{OLEDi}$. Since the OLED voltage increases for a constant luminance while its luminance decreases, the gate-source voltage of the transistor 164 increases resulting in higher OLED current. Consequently, the OLED 176 luminance remains constant.

Figure 6:
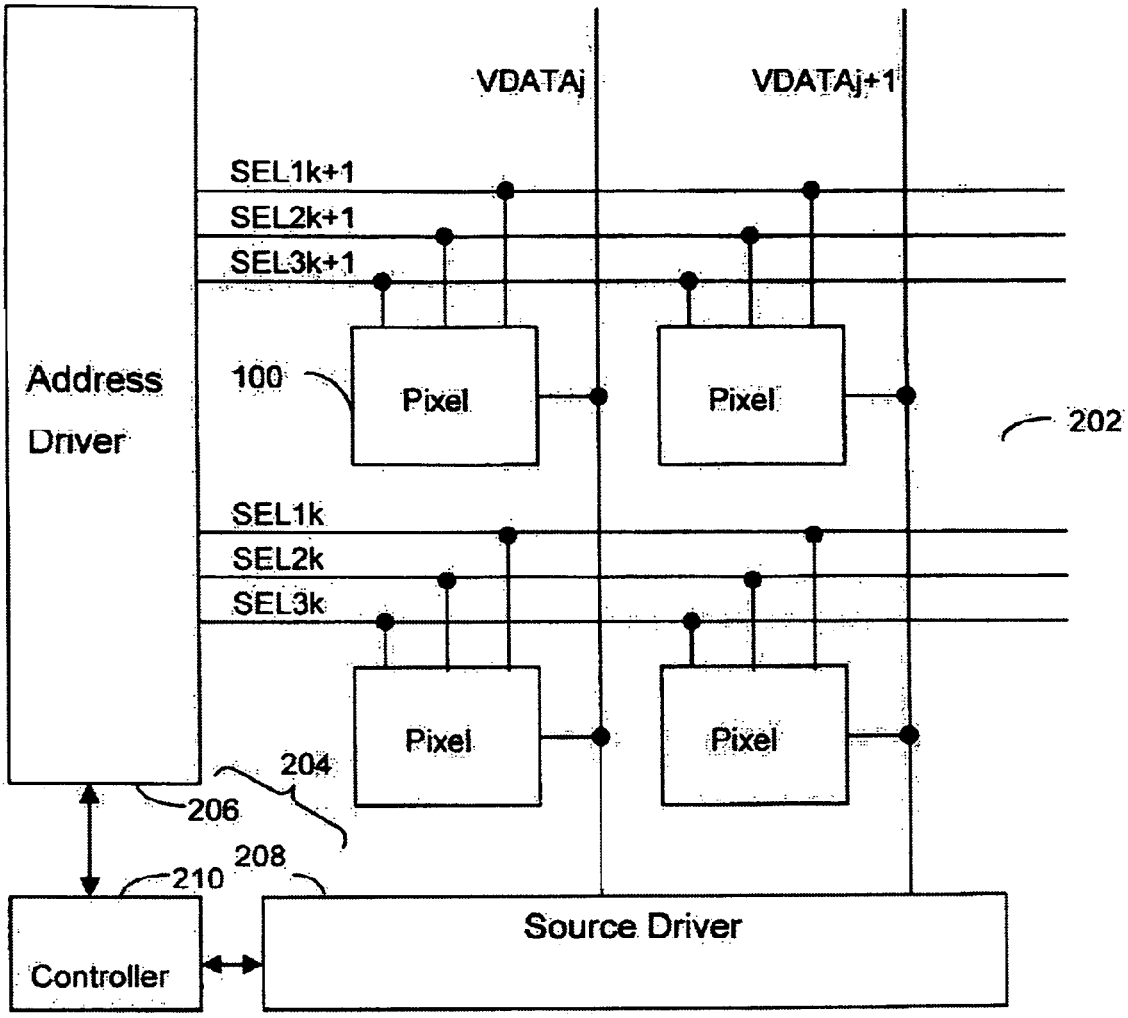
FIG. 6 is a diagram illustrating an example of a display system with a display array having the pixel circuit of FIG. 1A.

FIG. 6 illustrates an example of a display system 200 including the pixel circuit 100 of FIG. 1A. The display array 202 of FIG. 6 includes a plurality of pixel circuit 100 arranged in rows and columns, and may form an active matrix organic light emitting diode (AMOLED) display. VDATAj (j=1, 2, . . . ) corresponds to VDATA of FIG. 1A. SEL1*k*, SEL2*k* and SEL3*k* (k=1, 2, . . . ) correspond to SEL1, SEL2 and SEL3 of FIG. 1A, respectively. The select lines SEL1*k*, SEL2*k* and SEL3*k* are shared among the pixels in the common row of the display array 202. The signal line VDATAj is shared among the pixels in the common column of the display array 202.

The display system 200 includes a driving module 204 having an address driver 206, a source driver 208, and a controller 210. The select lines SEL1*k*, SEL2*k* and SEL3*k* are driven by the address driver 206. The signal line VDATAj is driven by the source driver 208. The controller 210 controls the operation of the address driver 206 and the source driver 208 to operate the display array 202.

The waveforms shown in FIG. 1B are generated by the driving module 204. The driver module 204 also generate the programming voltage. The compensation for OLED degradation, threshold voltage shift and ground bouncing occur in pixel. During the third cycle (122 of FIG. 1B), the gate-source voltage of the driving transistor is defined by the voltage stored in the storage capacitor (112 of FIG. 1). Therefore, the ground bouncing does not change the gate-source voltage and so the pixel current become stable.

Figure 7:
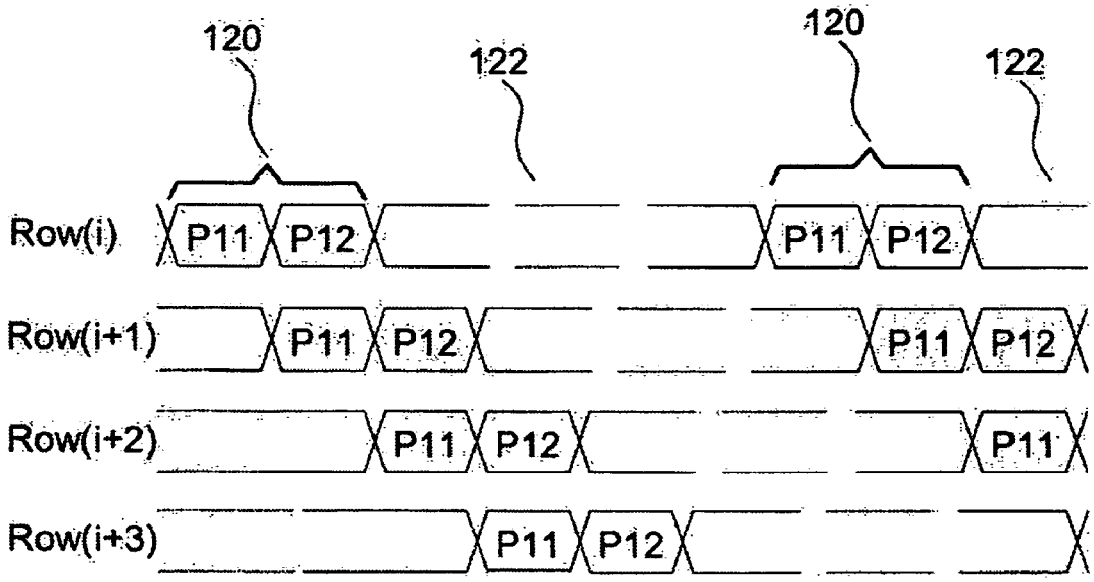
FIG. 7 is a timing diagram illustrating an example of a method of operating the display array of FIG. 6.

FIG. 7 illustrates an example of a method of operating the display array of FIG. 6. an example of In FIG. 7, Row(i) (i=1, 2, . . . ) represents a row of the s display array 202 of FIG. 6. "120" and "122" in FIG. 7 represent "programming cycle" and "driving cycle" and correspond to those of FIG. 1B, respectively. "P11" and "P12" in FIG. 7 represent "pre-charging sub-cycle" and "compensation sub-cycle" and correspond to those of FIG. 1B, respectively. The compensation sub-cycle P11 in a row and the pre-charging sub-cycle P12 in an adjacent row are performed in parallel. Further, during the driving cycle 122 in a row, the compensation sub-cycle P22 is performed in an adjacent row. The display system 200 of FIG. 6 is designed to implement the parallel operation, i.e., having capability of carrying out different cycles independently without affecting each other.

Figure 8:
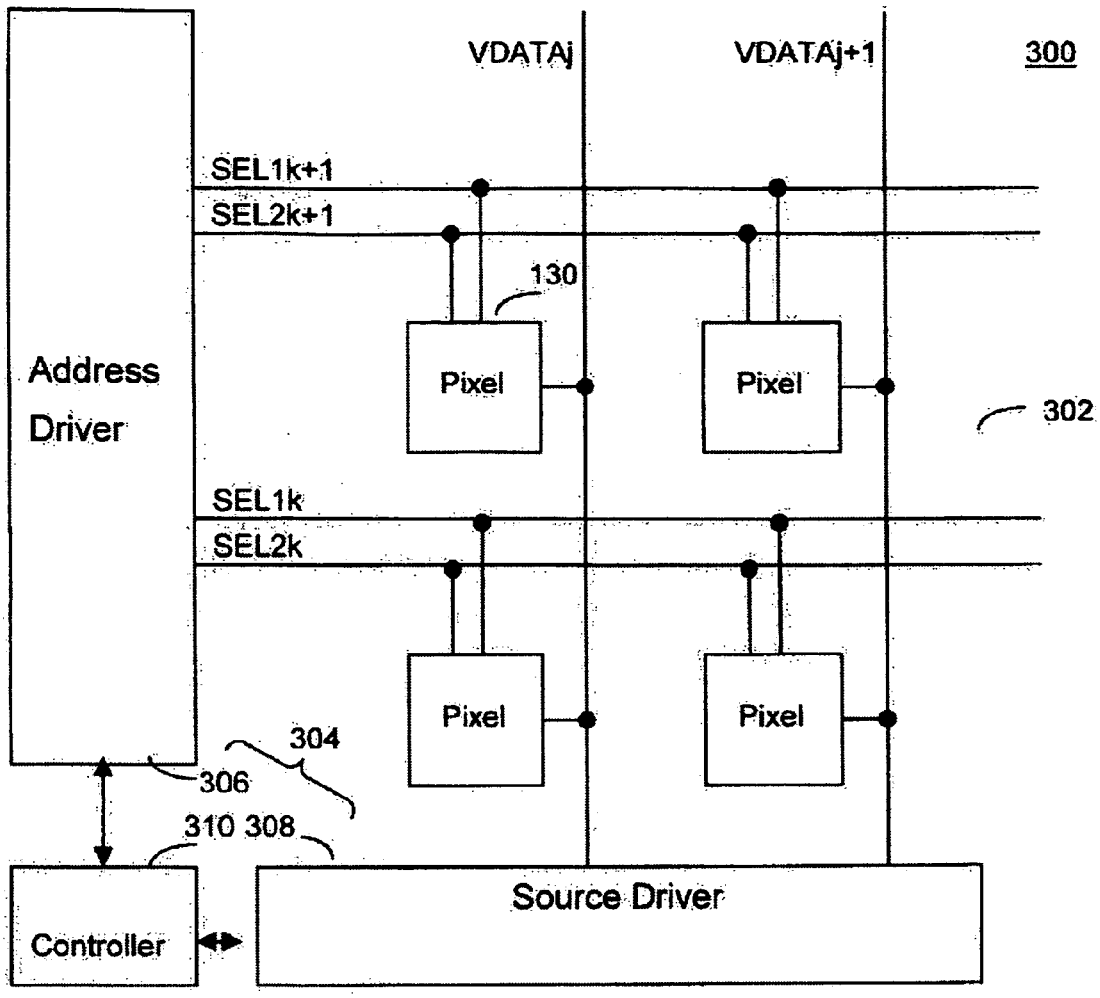
FIG. 8 is a diagram illustrating an example of a display system with a display array having the pixel circuit of FIG. 4A.

FIG. 8 illustrates an example of a display system 300 including the pixel circuit 130 of FIG. 4A. The display array 302 of FIG. 8 includes a plurality of pixel circuit 130 arranged in rows and columns, and may form an AMOLED display. VDATAj (j=1, 2, . . . ) corresponds to VDATA of FIG. 4A. SEL1*k* and SEL2*k* (k=1, 2, . . . ) correspond to SEL1 and SEL2 of FIG. 4A, respectively. The select lines SEL1*k* and SEL2*k* are shared among the pixels in the common row of the display array 302. The signal line VDATAj is shared among the pixels in the common column of the display array 302.

The display system 300 includes a driving module 304 having an address driver 306, a source driver 308, and a controller 310. The select lines SEL1*k* and SEL2*k* are driven by the address driver 306. The signal line VDATAj is driven by the source driver 308. The controller 310 controls the operation of the address driver 306 and the source driver 308 to operate the display array 302.

The waveforms shown in FIG. 4B are generated by the driving module 304. The driver module 304 also generates the programming voltage. The compensation for OLED degradation, threshold voltage shift and ground bouncing occur in pixel. During the third cycle (152 of FIG. 4B), the gate-source voltage of the driving transistor is defined by the voltage stored in the storage capacitor (142 of FIG. 4A). Therefore, the ground bouncing does not change the gate-source voltage and so the pixel current become stable.

Figure 9:
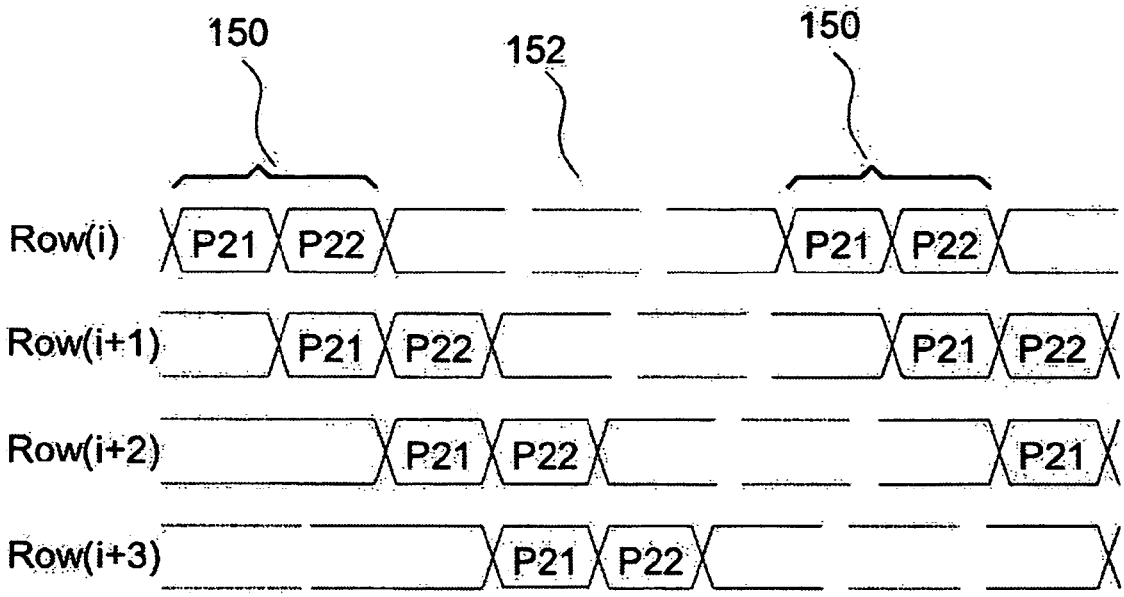
FIG. 9 is a timing diagram illustrating an example of a method of operating the display array of FIG. 8.

FIG. 9 illustrates an example of a method of operating the display array of FIG. 8. an example of In FIG. 9, Row(i) (i=1, 2, . . . ) represents a row of the display array 302 of FIG. 8. "150" and "152" in FIG. 9 represent "programming cycle" and "driving cycle" and correspond to those of FIG. 4B, respectively. "P21" and "P22" in FIG. 9 represent "pre-charging sub-cycle" and "compensation sub-cycle" and correspond to those of FIG. 4B, respectively. The compensation sub-cycle P21 in a row and the pre-charging sub-cycle P22 in an adjacent row are performed in parallel. Further, during the driving cycle 152 in a row, the compensation sub-cycle P22 is performed in an adjacent row. The display system 300 of FIG. 8 is designed to implement the parallel operation, i.e., having capability of carrying out different cycles independently without affecting each other.

Figure 10:
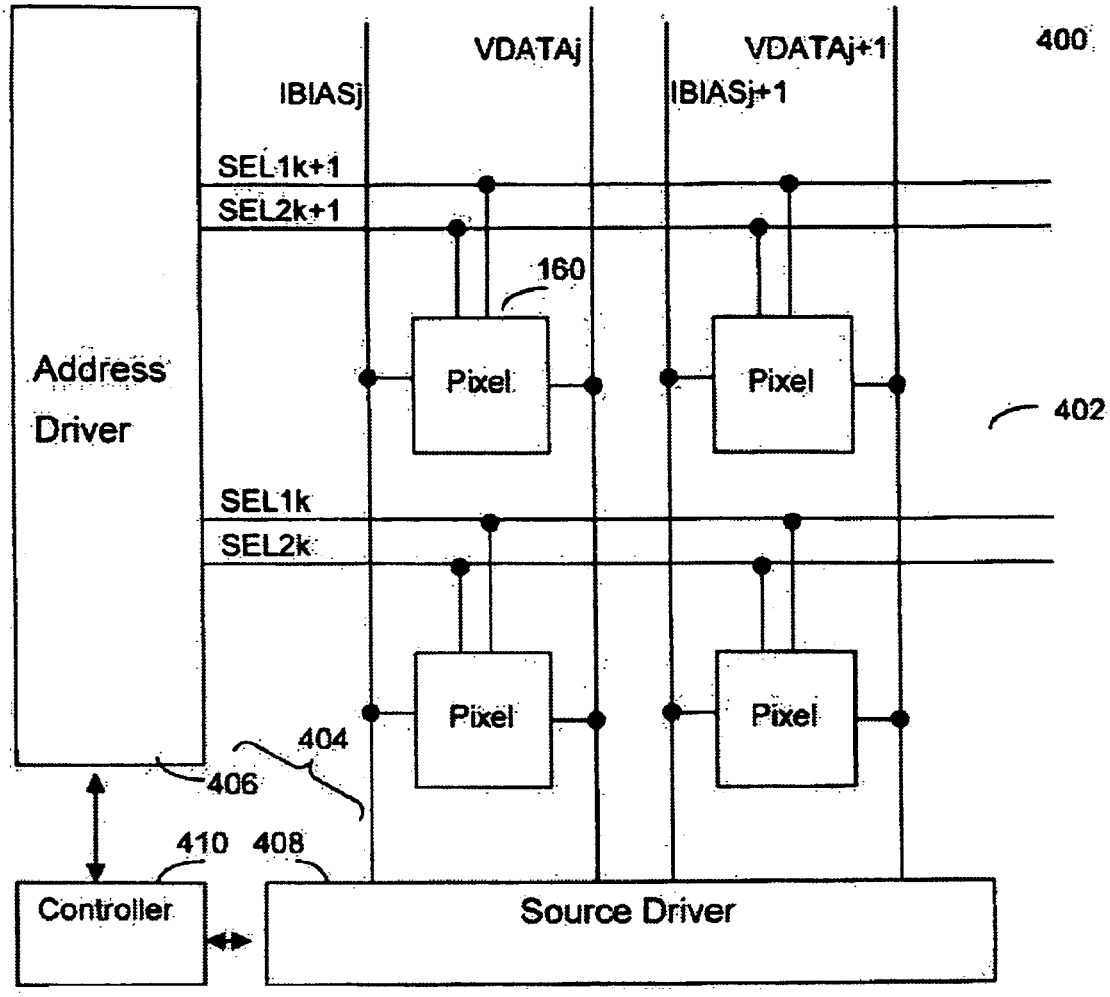
FIG. 10 is a diagram illustrating an example of a display system with a display array having the pixel circuit of FIG. 5A.

FIG. 10 illustrates an example of a display system 400 including the pixel circuit 160 of FIG. 5A. The display array 402 of FIG. 10 includes a plurality of pixel circuit 160 arranged in rows and columns, and is an AMOLED display. The display array 402 may be an AMOLED display. VDATAj (j=1, 2, . . . ) corresponds to VDATA of FIG. 4A. IBIASj (j=1, 2, . . . ) corresponds to IBIAS of FIG. 4A. SEL1*k* and SEL2*k* (k=1, 2, . . . ) correspond to SEL1 and SEL2 of FIG. 4A, respectively. The select lines SEL1*k* and SEL2*k* are shared among the pixels in the common row of the display array 402. The signal line VDATAj and the bias line IBIASj are shared among the pixels in the common column of the display array 402.

The display system 400 includes a driving module 404 having an address driver 406, a source driver 408, and a controller 410. The select lines SEL1*k* and SEL2*k* are driven by the address driver 406. The signal line VDATAj and the bias line IBIASj are driven by the source driver 408. The controller 410 controls the operation of the address driver 406 and the source driver 408 to operate the display array 402.

The waveforms shown in FIG. 5B are generated by the driving module 404. The driver module 404 also generate the programming voltage. The compensation for OLED degradation, threshold voltage shift and ground bouncing occur in pixel. During the second cycle 182 of FIG. 5B, the gate-source voltage of the driving transistor is defined by the voltage stored in the storage capacitor (174 of FIG. 5A). Therefore, the ground bouncing does not change the gate-source voltage and so the pixel current become stable.

Figure 11:
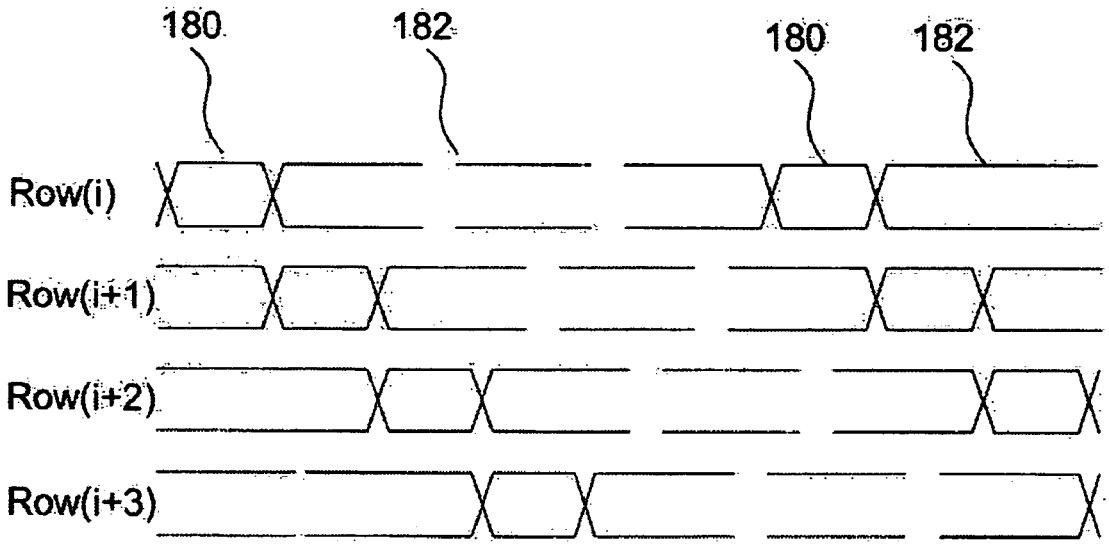
FIG. 11 is a timing diagram illustrating an example of a method of operating the display array of FIG. 10.

FIG. 11 illustrates an example of a method of operating the display array of FIG. 10. an example of In FIG. 9, Row(i) (i=1, 2, . . . ) represents a row of the display array 402 of FIG. 10. "180" and "182" in FIG. 11 correspond to those of FIG. 5B, respectively. For the rows of the display array 402, the programming cycle 180 is subsequently performed. During the driving cycle 182 in a row, the programming cycle 180 is performed in an adjacent row. The display system 400 of FIG. 10 is designed to implement the parallel operation, i.e., having capability of carrying out different cycles independently without affecting each other.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A pixel circuit comprising:

a light emitting device;

a storage capacitor having a first terminal and a second terminal;

a first transistor having a gate terminal, a first terminal and a second terminal, the gate terminal being connected to a first select line, the first terminal of the first transistor being connected to a first voltage supply;

a second transistor having a gate terminal, a first terminal and a second terminal, the first terminal of the second transistor being connected to the second terminal of the first transistor, the second terminal of the second transistor being connected to the light emitting device;

a third transistor having a gate terminal, a first terminal and a second terminal, the gate terminal being connected to a second select line, the first terminal being connected to the second terminal of the first transistor, the second terminal being connected to the gate terminal of the second transistor and the first terminal of the storage capacitor;

a fourth transistor having a gate terminal, a first terminal and a second terminal, the gate terminal being connected to a third select line, the first terminal being connected to the second terminal of the storage capacitor, the second terminal being connected to the second terminal of the second transistor and the light emitting device; and a fifth transistor having a gate terminal, a first terminal and a second terminal, the gate terminal being connected to the second select line, the first terminal connected to a signal line, the second terminal being connected to the first terminal of the fourth transistor and the second terminal of the storage capacitor.

2. A pixel circuit according to claim 1, wherein the first select line, the second select line and the third select line are driven to forma programming cycle and a driving cycle, the programming cycle including a pre-charge cycle and a compensation cycle.

3. A pixel circuit according to claim 2, wherein the storage capacitor is charged during the pre-charge cycle, the storage capacitor being discharged during the compensation cycle, and the second terminal of the storage capacitor being disconnected from the signal line and being connected to the second terminal of the second transistor by setting the second select line to turn off the fifth transistor and the third select line to turn on the fourth transistor during the driving cycle.

4. A pixel circuit according to claim 3, wherein the first select line, the second select line, and the signal line are driven such that during the compensation cycle, the storage capacitor stores a voltage computed based on a threshold voltage of the second transistor, a voltage associated with the light emitting device and a programming voltage.

5. A pixel circuit according to claim 1, wherein the third select line is the first select line.

6. A pixel circuit according to claim 5, wherein the first select line and the second select line are driven to form a programming cycle and a driving cycle, the programming cycle including a pre-charge cycle and a compensation cycle.

7. A pixel circuit according to claim 6, wherein the storage capacitor is charged during the pre-charge cycle, the storage capacitor being discharged during the compensation cycle, and the second terminal of the storage capacitor being disconnected from the signal line and being connected to the second terminal of the second transistor by setting the second select line to turn off the fifth transistor and the third select line to turn on the fourth transistor during the driving cycle.

8. A pixel circuit according to claim 7, wherein the first select line, the second select line and the signal line are driven such that during the compensation cycle, the storage capacitor stores a voltage computed based on a threshold voltage of the second transistor, a voltage associated with the light emitting device and a programming voltage.

9. A pixel circuit according to claim 5, further comprising a sixth transistor having a gate terminal, a first terminal and a second terminal, the gate terminal being connected to the second select line, the first terminal being connected to the first terminal of the second transistor, the second terminal being connected to a bias current line.

10. A pixel circuit according to claim 9, wherein the first select line and the second select line are driven to form a first operating cycle and a second operating cycle.

11. A pixel circuit according to claim 10, wherein the storage capacitor is connected to the signal line and the bias current line during the first operating cycle, the storage capacitor being disconnected from the signal line and the bias current line and the second terminal of the storage capacitor being connected to the second terminal of the second transistor by setting the second select line to turn off the fifth transistor and the third select line to turn on the fourth transistor during the second operating cycle.

12. A pixel circuit according to claim 11, wherein the first select line, the second select line, the bias current line and the signal line are driven such that the storage capacitor stores a voltage computed based on a threshold voltage of the second transistor, a voltage associated with the light emitting device, and a programming voltage.

13. A display system comprising:

a display array formed by the pixel circuit of claim 9;

a driving module for driving the first select line, and the second select line shared by a row of the display array, and for driving the signal line and the bias current line shared by a column of the display array, thereby forming a first operating cycle and a second operating cycle, the storage capacitor being connected to the signal line and the bias current line by setting the second select line to turn on the third transistor, the fifth transistor and the sixth transistor during the first operating cycle, the storage capacitor being disconnected from the signal line and the bias current line and being connected to the second transistor by setting the second select line to turn off the fifth transistor and the third select line to turn on the fourth transistor during the second operating cycle.

14. A display system according to claim 13, wherein the driver module operates in parallel the first operating cycle of a first row of the display array and the second operating cycle of a second row of the display array, the second row being adjacent to the first row.

15. A method for compensating for ground bouncing or voltage drop in the pixel circuit of claim 9, comprising the steps of:

charging the storage capacitor, including connecting the storage capacitor to the signal line and the bias current line;

discharging the storage capacitor; and disconnecting the storage capacitor from the signal line and the bias current line and connecting the second terminal of the storage capacitor to the second terminal of the second transistor by setting the second select line to turn off the fifth transistor and the third select line to turn on the fourth transistor.

16. A method according to claim 15, wherein a voltage, computed based on a threshold voltage of the second transistor, a voltage associated with the light emitting device, and a programming voltage is stored in the storage capacitor to drive the pixel circuit.

17. A display system comprising:

a display array formed by the pixel circuit of claim 5;

a driving module for driving the first select line, and the second select line shared by a row of the display array and for driving the signal line shared by a column of the display array, thereby forming a programming cycle and a driving cycle for the row of the display array, the programming cycle having a pre-charge cycle and a compensation cycle, the storage capacitor being charged during the pre-charge cycle, the storage capacitor being discharged during the compensation cycle, and the second terminal of the storage capacitor being disconnected from the signal line and being connected to the second terminal of the second transistor by setting the second select line to turn off the fifth transistor and the third select line to turn on the fourth transistor during the driving cycle.

18. A display system according to claim 17, wherein the driver module operates in parallel the pre-charging cycle of a first row of the display array and the compensation cycle of a second row of the display array, the second row being adjacent to the first row.

19. A pixel circuit according to claim 1, wherein the light emitting device is an organic light emitting diode.

20. A pixel circuit according to claim 1, wherein the pixel circuit forms an electro-luminance device display.

21. A pixel circuit according to claim 20, wherein the pixel circuit forms an active matrix light emitting display.

22. A pixel circuit according to claim 21, wherein the display is an active matrix organic light emitting display.

23. A pixel circuit according to claim 1, wherein at least one of the transistors includes amorphous, nano/micro crystalline, poly, organic material, n-type material, p-type material, or CMOS silicon.

24. A pixel circuit according to claim 1, wherein the at least one of the transistors is a n-type or p-type TFT.

25. A display system comprising:

a display array formed by the pixel circuit of claim 1; and a driving module for driving the first select line, the second select line, and the third select line shared by a row of the display array and for driving the signal line shared by a column of the display array, thereby forming a programming cycle and a driving cycle for the row of the display array, the programming cycle including a pre-charge cycle and a compensation cycle, the storage capacitor being charged during the pre-charge cycle, the storage capacitor being discharged during the compensation cycle, and the second terminal of the storage capacitor being disconnected from the signal line and being connected to the second terminal of the second transistor by setting the second select line to turn off the fifth transistor and the third select line to turn on the fourth transistor during the driving cycle.

26. A display system according to claim 25, wherein the driver module operates in parallel the pre-charging cycle of a first row of the display array and the compensation cycle of a second row of the display array, the second row being adjacent to the first row.

27. A method for compensating for degradation of the light emitting device of claim 1, comprising the steps of:

charging the storage capacitor, including connecting the storage capacitor to the signal line;

discharging the storage capacitor; and disconnecting the storage capacitor from the signal line and connecting the second terminal of the storage capacitor to the second terminal of the second transistor by setting the second select line to turn off the fifth transistor and the third select line to turn on the fourth transistor.

28. A method according to claim 27, wherein a voltage, computed based on a threshold voltage of the second transistor, a voltage associated with the light emitting device and a programming voltage is stored in the storage capacitor to drive the pixel circuit.

29. A method according to claim 27, wherein the step of charging the storage capacitor includes turning on the first transistor, the third transistor and the fifth transistor so that the storage capacitor is charged.

30. A method according to claim 29, wherein at the end of the step of charging the storage capacitor, the storage capacitor stores a voltage computed based on a voltage on the first voltage supply, a programming voltage and an initial voltage of the light emitting device.

31. A method according to claim 27, wherein the step of discharging the storage capacitor includes turning off the first transistor so that the storage capacitor is discharged until a current via the second transistor and the light emitting device becomes close to zero.

32. A method according to claim 31, wherein at the end of the step of discharging the storage capacitor, the storage capacitor stores a voltage computed based on a threshold voltage of the second transistor, a programming voltage, and a voltage associated with the light emitting device.

33. A method according to claim 27, wherein the step of disconnecting the storage capacitor includes turning off the third transistor and the fifth transistor and turning on the first transistor and the fourth transistor so that the storage capacitor is electrically disconnected from the signal line and the second terminal of the storage capacitor is electrically connected to the second terminal of the second transistor.

34. A method for compensating for shift in a threshold voltage of the second transistor in the pixel circuit of claim 1, comprising the steps of:

charging the storage capacitor, including connecting the storage capacitor to the signal line;

discharging the storage capacitor; and disconnecting the storage capacitor from the signal line and connecting the second terminal of the storage capacitor to the second terminal of the second transistor by setting the second select line to turn off the fifth transistor and the third select line to turn on the fourth transistor.

35. A method according to claim 34, wherein a voltage, computed based on a threshold voltage of the second transistor, a voltage associated with the light emitting device and a programming voltage is stored in the storage capacitor to drive the pixel circuit.

36. A method for compensating for shift in a threshold voltage of the transistor in the pixel circuit of claim 1, comprising the steps of:

at a pre-charge cycle, turning on the first transistor, the third transistor and the fifth transistor so that the storage capacitor is charged;

at a compensation cycle, turning off the first transistor so that the storage capacitor is discharged until a current via the second transistor and the light emitting device becomes close to zero; and at a driving cycle, turning off the third transistor and the fifth transistor and turning on the first transistor and the fourth transistor so that the storage capacitor is electrically disconnected from the signal line and the second terminal of the storage capacitor is electrically connected to the second terminal of the second transistor.

37. A method according to claim 36, wherein the pre-charge cycle includes setting the first select line and the second select line to high; and the compensation cycle includes setting the first select line to low.

38. A method according to claim 37, at the pre-charge cycle, further comprising the steps of setting the signal line to a voltage computed based on a programming voltage and an initial voltage of the light emitting device.

39. A method according to claim 37, wherein at the end of the pre-charge cycle, the storage capacitor is charged to a voltage computed based on a voltage on the first voltage supply, a programming voltage and an initial voltage of the light emitting device.

40. A method according to claim 36, wherein at the end of the compensation cycle, the storage capacitor is charged to a voltage computed based on a threshold voltage of the second transistor, a programming voltage, and a voltage associated with the light emitting device.

* * * * *